US012178267B2

(12) United States Patent
Kamphuis et al.

(10) Patent No.: US 12,178,267 B2
(45) Date of Patent: Dec. 31, 2024

(54) PROTECTIVE GLOVE

(71) Applicant: LiWell B.V., Nieuwkuijk (NL)

(72) Inventors: Maarten Alexander Kamphuis, Delft (NL); Marlies Moltmaker, Delft (NL)

(73) Assignee: LiWell B.V., Nieuwkuijk (NL)

( * ) Notice: Subject to any disclaimer, the term of this patent is extended or adjusted under 35 U.S.C. 154(b) by 0 days.

(21) Appl. No.: 18/565,431

(22) PCT Filed: Jun. 1, 2022

(86) PCT No.: PCT/NL2022/050306
§ 371 (c)(1),
(2) Date: Nov. 29, 2023

(87) PCT Pub. No.: WO2022/255874
PCT Pub. Date: Dec. 8, 2022

(65) Prior Publication Data

US 2024/0260693 A1 Aug. 8, 2024

(30) Foreign Application Priority Data

Jun. 3, 2021 (NL) ..... 2028380

(51) Int. Cl.
*A41D 19/015* (2006.01)

(52) U.S. Cl.
CPC . *A41D 19/01588* (2013.01); *A41D 19/01523* (2013.01)

(58) Field of Classification Search
CPC .. A41D 13/081; A41D 13/084; A41D 13/087; A41D 19/01523; A63B 71/14; A61F 5/05866
See application file for complete search history.

(56) References Cited

U.S. PATENT DOCUMENTS 3,626,515 A 12/1971 Murray
4,042,975 A 8/1977 Elliott
(Continued)

FOREIGN PATENT DOCUMENTS

KR 200356329 7/2004

*Primary Examiner* — Katherine M Moran
(74) *Attorney, Agent, or Firm* — Marcus C. Dawes

(57) ABSTRACT

The present invention relates to a protective glove configured to protect a dorsal side of a hand of a user, comprising: —a flexible layer configured to fit against a back of the hand and comprising extensions that are each configured to extend along and fit against a respective proximal phalanx of a finger; —a rigid shell configured to extend over a metacarpal area and over knuckles of the back of the hand to thereby protect the back of the hand, wherein said shell is supported by said flexible layer and arranged at an offset relative to the back of the hand to thereby define a gap between the shell and the back of the hand; —wherein one or more than one of the extensions that are configured to extend along the proximal phalanx of the finger supports a phalanx protector that is configured to extend over the respective proximal phalanx, —wherein the phalanx protector is further configured to extend over a corresponding knuckle of the hand; and—wherein, at least when the fingers are extended, the rigid shell and the phalanx protector define an overlap and the phalanx protector that extends over the corresponding knuckle extends in the offset that defines the gap between the rigid shell and the back of the hand.

15 Claims, 5 Drawing Sheets

(56) References Cited

U.S. PATENT DOCUMENTS

| | | | | |
|---|---|---|---|---|
| 4,193,135 | A * | 3/1980 | Rhee | A63B 71/14 2/162 |
| 5,640,712 | A * | 6/1997 | Hansen | A63B 71/143 2/161.1 |
| 6,219,843 | B1 * | 4/2001 | Passi | A63B 71/14 2/24 |
| 8,918,913 | B2 * | 12/2014 | Power | A41D 13/087 2/161.1 |
| 9,677,842 | B2 * | 6/2017 | Carlston | F41B 5/148 |
| 10,722,393 | B2 * | 7/2020 | Butler | A61F 5/05866 |
| 10,905,181 | B2 * | 2/2021 | Rabbeth, Jr. | A61F 5/013 |
| 11,096,435 | B2 * | 8/2021 | Kamphuis | A41D 19/01505 |

* cited by examiner

PROTECTIVE GLOVE

The present invention relates to a protective glove, in particular a protective glove that is configured to protect a dorsal side of a hand of a user.

Gloves are commonly used for protecting a hand against adverse conditions, such as thermal conditions (cold or heat), chemical conditions (acids, etc.), or mechanical conditions (abrasion or impact). Different protective conditions often have conflicting demands. For example, a comfortable glove providing sensitive control and impact resistance at the same time has contradictory demands.

Although user comfort is desirable for any type of glove, this is especially true for conditions wherein there is prolonged use, such as an industrial worker wearing the glove many hours a day, and during sports. In sports, for example during field hockey, lacrosse and ice hockey, the conflicting demands posed on gloves are especially related to providing impact protection while also maintaining optimal stick contact and control. Especially at elite level sports, the players feel of his/her stick is of utmost importance, and any discomfort may have a negative effect on the performance. It is desirable that the glove may be moved through its range of motion with minimal muscular effort.

KR 200 356 329 Y1, which is considered to form the closest prior art, discloses a motorcycle glove. Relative to this document, at least the characterizing features of claim 1 are novel.

U.S. Pat. No. 4,042,975 discloses a protective glove for protecting batters from hand injuries. The protective gloves each comprise a pair of protective plates that are releasably secured to the back side of the glove. The protective plates may have a thin layer of shock-absorbing cushioning, such as a resilient polyurethane foam material. This layer of cushioning may be attached to the underside of the plate by a layer of adhesive, and a VELCRO fastener may be secured to the lower face of the cushioning layer by a second layer of adhesive. The VELCRO fasteners allow the protective plates to be releasably attached to corresponding fastener sections on the glove, thereby creating a direct contact between the VELCRO fasteners of the protective plates and the glove. In use, one protective plate covers the back of the hand and the other protective plate covers the lower portions of the fingers. The two protective plates are spaced apart to allow freedom of movement of the knuckles at the base of the fingers between the plates, but the plates are spaced sufficiently close to each other to protect these knuckles. The spacing between the plates may be set sufficiently narrow to prevent a curvature of a baseball from making any substantial contact with the exposed metacarpal phalangeal joints of the batter's hand. Thus, even though the knuckles are not directly covered by the plate in order to provide a desired freedom of movement of the metacarpal phalangeal joints, the nature of the object—i.e. a baseball having a known size and shape—allows these joints to be protected against impact. Although the protective glove of U.S. Pat. No. 4,042,975 provides protection against impact by relatively large objects such as baseballs, it would not offer any protection against smaller objects, such as a tip of a hockey stick, ice hockey stick, ice hockey puck, or an edge of a head of a lacrosse stick.

U.S. Pat. No. 3,626,515 discloses a protector for the back of a hockey glove comprising a layer of relatively rigid and unbreakable material sandwiched between layers of shock absorbing material and formed over the back and around the side of the glove. The finger engaging portions are conventional in form and each include suitable padding of sponge rubber or other shock absorbing material secured to the upper side thereof with additional padding positioned laterally of the glove to provide padding for the knuckles and to permit the finger engaging portions to be bent and flexed.

An objective of the present invention is to provide a glove, that is improved relative to the prior art and wherein a high level of user comfort and protection go hand in hand. Said objective is achieved with the protective glove according to claim 1 of the present invention, that is configured to protect a dorsal side of a hand of a user, and that comprises:

- a flexible layer configured to fit against a back of the hand and comprising extensions that are each configured to extend along and fit against a respective proximal phalanx of a finger;
- a rigid shell configured to extend over a metacarpal area and over knuckles of the back of the hand to thereby protect the back of the hand, wherein said shell is supported by said flexible layer and arranged at an offset relative to the back of the hand to thereby define a gap between the shell and the back of the hand;
- wherein one or more than one of the extensions that are configured to extend along the proximal phalanx of the finger supports a phalanx protector that is configured to extend over the respective proximal phalanx,
- wherein the phalanx protector is further configured to extend over a corresponding knuckle of the hand; and
- wherein, at least when the fingers are extended, the rigid shell and the phalanx protector define an overlap and the phalanx protector that extends over the corresponding knuckle extends in the offset that defines the gap between the rigid shell and the back of the hand.

A "gap" is defined as an unfilled or empty space. The gap between the shell and the back of the hand prevents direct contact between the back of the hand and the shell. In this way, user comfort is increased and muscular effort for moving the hand is reduced. Furthermore, the gap allows for ventilation to even further increase user comfort. The result is a comfortable glove that can be moved through its range of motion with minimal muscular effort.

Moreover, the offset between the shell and the back of the hand that defines the gap not only prevents direct contact between the back of the hand and the shell, but also allows the phalanx protector to move in the offset, i.e. in the gap, between the rigid shell and the back of the hand. In this way, a protection during the full range of motion may be obtained. After all, when the fingers are bent to grab an object, such as a players stick, or to make a fist, the phalanx protectors move relative to the distal edge of the rigid shell, at the location of the knuckles, causing the level of overlap to change.

According to a preferred embodiment, the rigid shell and the phalanx protector define an overlap during a full range of motion from the fingers being extended to the fingers being bent for grabbing an object and vice versa. In this way, increased protection is obtained during the full range of motion of the hand.

According to a further preferred embodiment, the protective glove comprises a further offset between the rigid shell and the phalanx protector at the overlap to thereby allow the phalanx protector to freely move relative to the rigid shell. The phalanx protector may be able to move inside the open space defined by the gap, allowing the phalanx protector to move substantially without any friction in the fee space of the gap, i.e. relative to a distal edge of the rigid shell. The further offset between the rigid shell and the phalanx protector allows the phalanx detector to move at a distance from the rigid shell and thereby prevent direct sliding contact between the phalanx protector and the rigid shell. If the phalanx protector remains at a distance relative to the shell, any shear force there between that would be caused if there would be a sliding contact, is prevented. In this way, user comfort is even further increased, because muscular effort for moving the hand and/or the fingers of the hand is reduced. The further offset also allows for ventilation to even further increase user comfort.

Further preferred embodiments are the subject of the dependent claims.

In the following description preferred embodiments of the present invention are further elucidated with reference to the drawing, in which.

Figure 1:
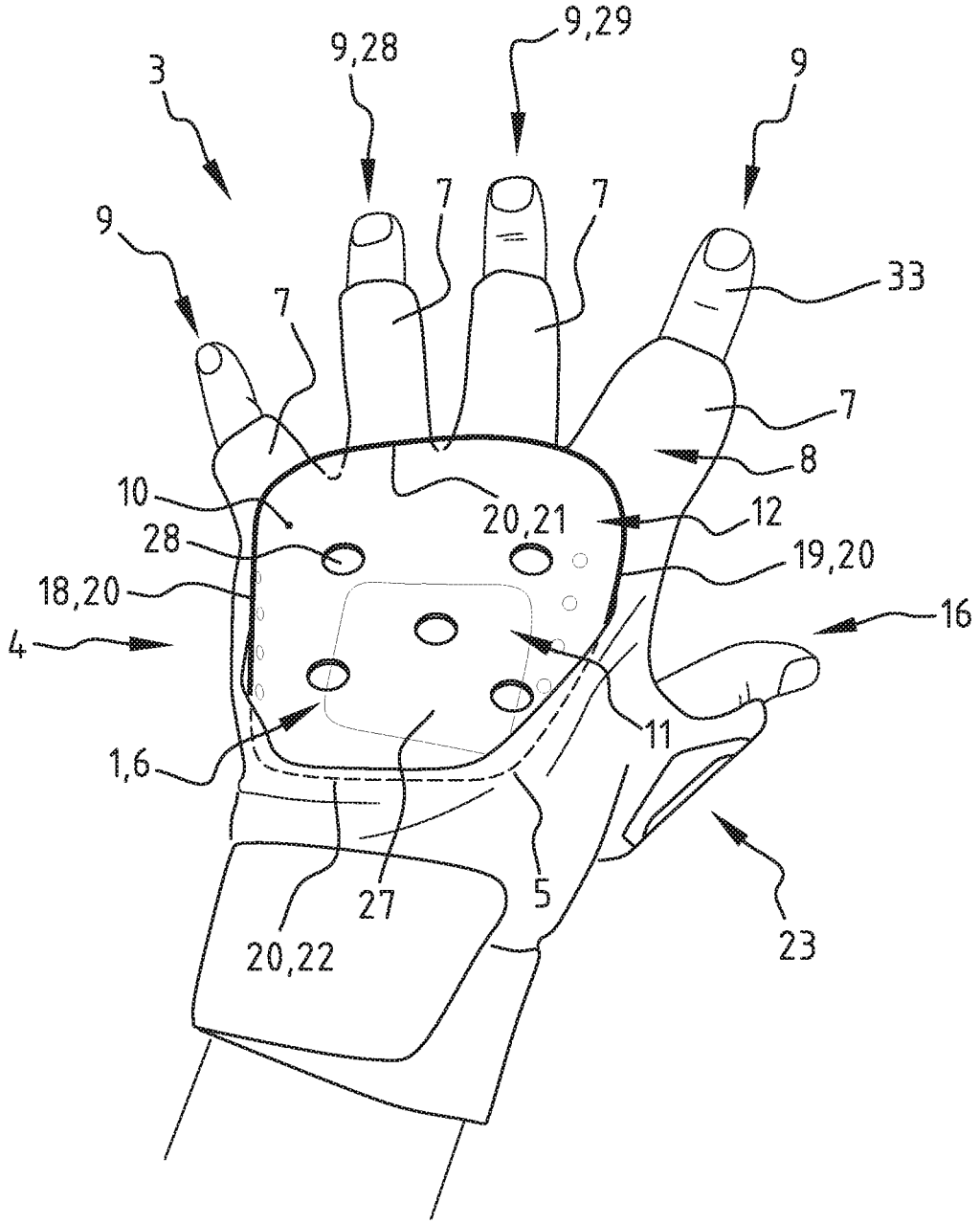
FIG. 1 is a view of a dorsal side of a hand of a user wearing a protective glove according to a first preferred embodiment of the invention.
Figure 2:
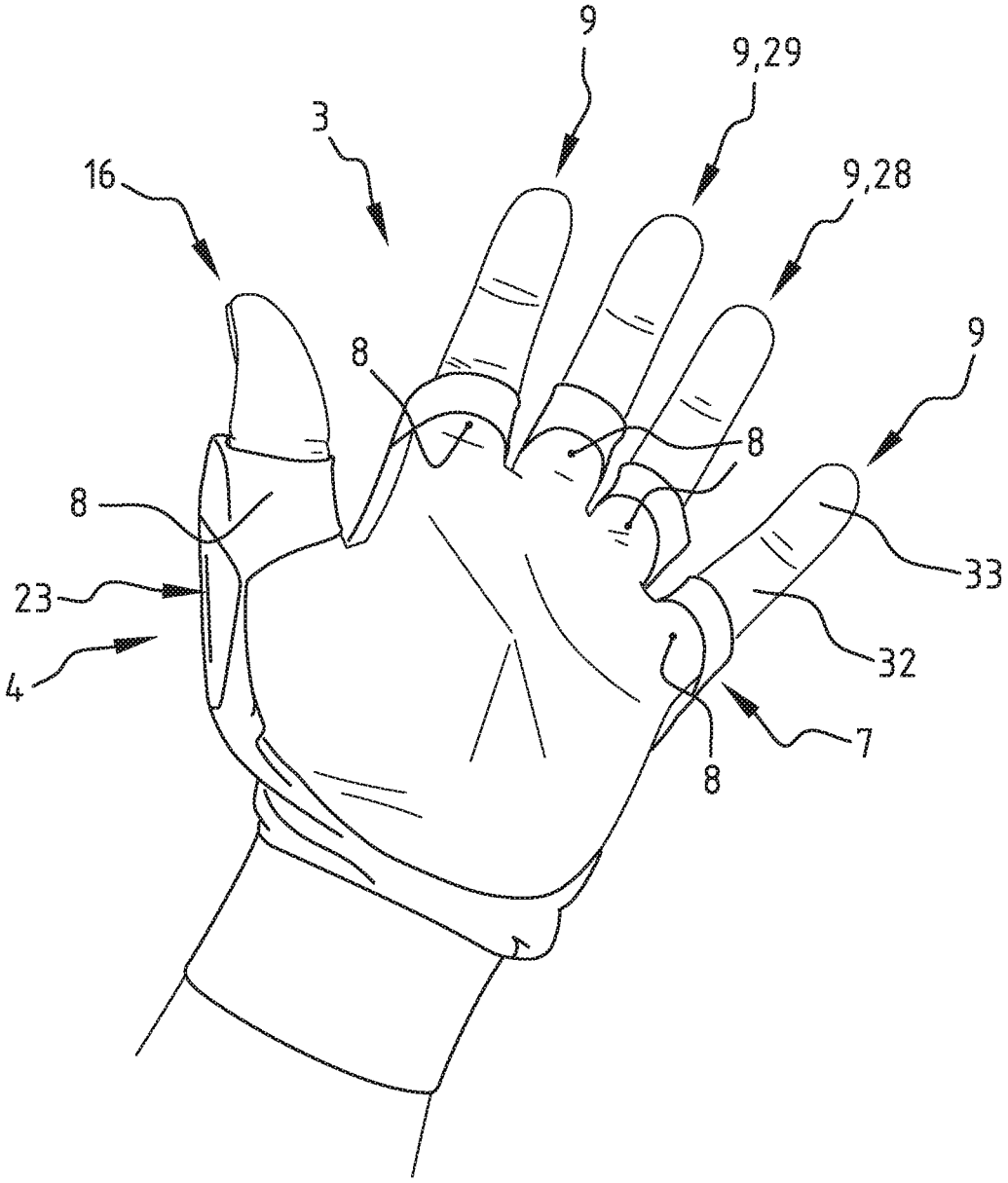
FIG. 2 is a view of a palmar side of the hand of FIG. 1.

In FIGS. 1 and 2, a dorsal side 1 and a palmar side 2 of a hand 3 of a user are shown, respectively. The user is wearing a protective glove 4 that is configured to protect the dorsal side 1 of his/her hand 3. The back 6 of the hand 3 is arranged at the dorsal side 1. The palmar side 2 is sometimes also referred to as volar side.

The protective glove 4 comprises a flexible layer 5 that is configured to fit, in particular tightly or snugly fit, against a back 6 of the hand 3. The flexible layer 5 preferably comprises a fabric.

The flexible layer 5 comprises extensions 7 that are each configured to extend along and fit against a respective proximal phalanx 8 of a finger 9. A rigid shell 10 is configured to extend over a metacarpal area 11 and over knuckles 12 of the back 6 of the hand 3 to thereby protect the back 6 of the hand 3. Said shell 10 is supported by said flexible layer 5 and is arranged at an offset 13 relative to the back 6 of the hand 3 to thereby define a gap 14, i.e. an open or unfilled space, between the shell 10 and the back 6 of the hand 3.

The gap 14 between the shell 10 and the back 6 of the hand 3 prevents direct contact between the back 6 of the hand 3 and the shell 10. In this way, user comfort is increased and muscular effort for moving the hand 3 is reduced. Furthermore, the gap 14 allows for ventilation to even further increase user comfort.

In the shown preferred embodiment, the flexible layer 5 comprises extensions 7 for each of the four fingers 9, and the rigid shell 10 extends over each knuckle 12 corresponding to one of the four fingers 9. An even further extension 15 may extend along and fit against a proximal phalanx 8 of the thumb 16.

If the shell 10 is exposed to an impact, it distributes the force of this impact over an increased area where the shell contacts the hand, thereby reducing the resulting pressure and consequently reducing the risk of injury. Moreover, the shell 10 may distribute the force to areas of the hand that are less prone to injury. For example, an impact at the metacarpal area that comprises the metacarpal bones may be distributed to other areas of the hand.

In order to further reduce the risk of injury resulting from an impact, the shell 10 may be supported by said flexible layer 5 via a compressible padding 17 that is arranged between the flexible layer 5 and the rigid shell 10. The compressible padding 17 may comprise a compressible foam layer. For example, the foam layer may be Poron® XRD. The shell 10 may be made of polycarbonate or any other suitable material.

In the shown embodiment, the compressible padding 17 is arranged at an ulnar edge 18 and at a radial edge 19 of the outer circumference 20 of the shell 10 and the compressible padding 17 is absent in the metacarpal area 11 there between to define the gap 14 between the shell 10 and the back 6 of the hand 3 at said metacarpal area 11. The metacarpal area 11 is defined as an area where the metacarpal bones of the hand are located.

The compressible padding 17 is absent at a distal edge 21 of the outer circumference 20 of the shell 10 to define the gap 14 between the shell 10 and the back 6 of the hand 3 at the knuckles 12 of the hand 3. In order to increase the area of the compressible padding 17, it is preferably furthermore arranged along a proximal edge 22 of the outer circumference 20 of the shell 10.

One or more than one of the extensions 7 that are configured to extend along the proximal phalanx 8 of the finger 9 preferably support a phalanx protector 23 that is configured to extend over the respective proximal phalanx 8 and a corresponding knuckle 12 of the hand 3. Likewise, a phalanx protector 23 may protect a proximal phalanx 8 of the thumb 16. Phalanx protectors may provide increased protection of the dorsal side 1 of the hand 3, because—in addition to the shell 10 protecting the back 6 of the hand 3—the one or more than one phalanx protector 23 also protects at least a part of a dorsal side 1 of the fingers 9 and/or thumb 16.

At least when the fingers 9 are extended, the rigid shell 10 and the phalanx protector 23 define an overlap 24 (FIG. 3B), thereby providing increased protection during opening of the hand 3. Preferably, the rigid shell 10 and the phalanx protector 23 define an overlap 24 during a full range of motion from the fingers 9 being extended (FIG. 3B) to the fingers 9 being bent (FIG. 3A) for grabbing an object 25 and vice versa. In this way, increased protection is obtained during the full range of motion of the hand 3.

Figure 3A:
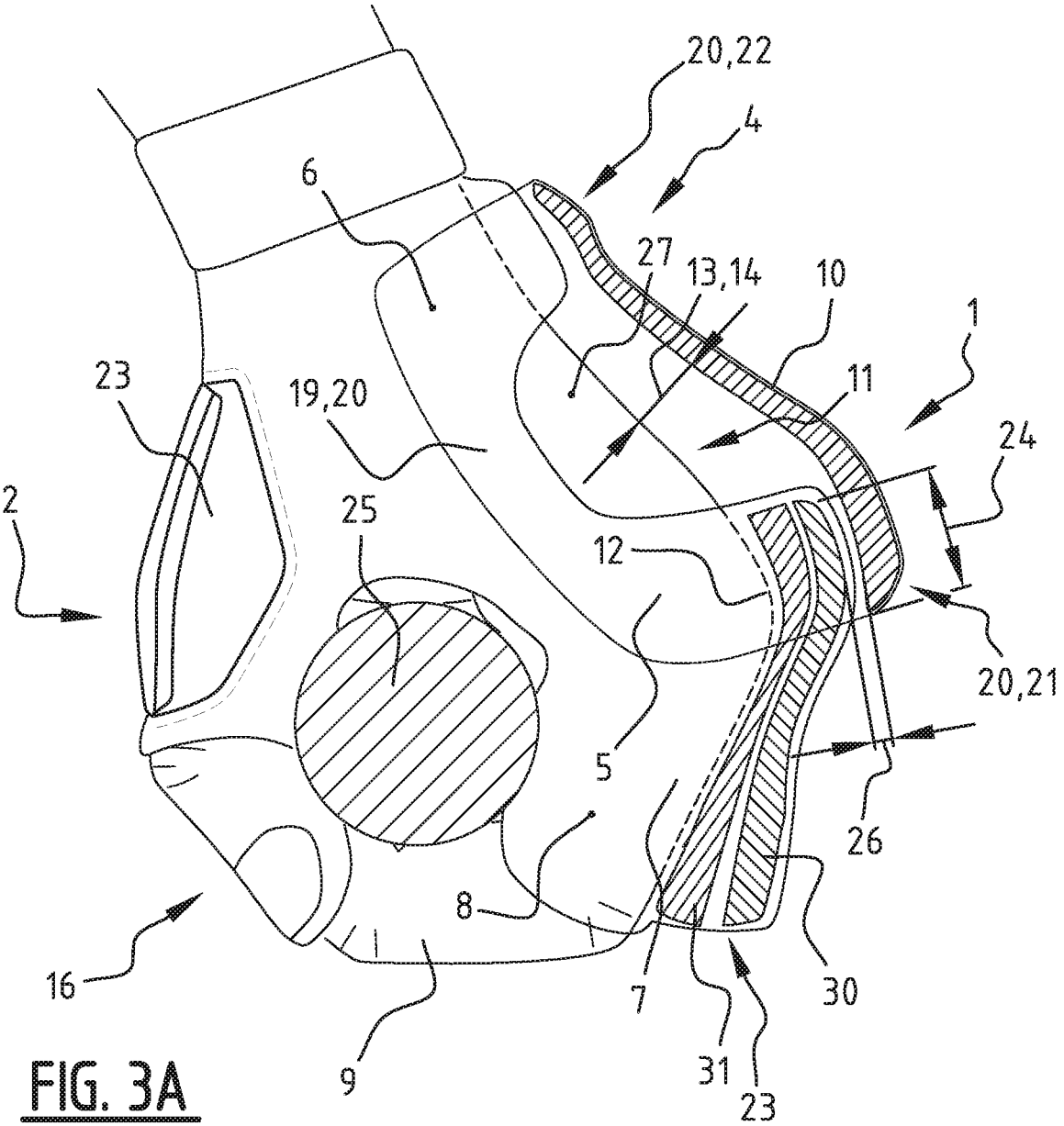
FIG. 3A is a view of a radial side of the hand of FIG. 1 holding an object.
Figure 3B:
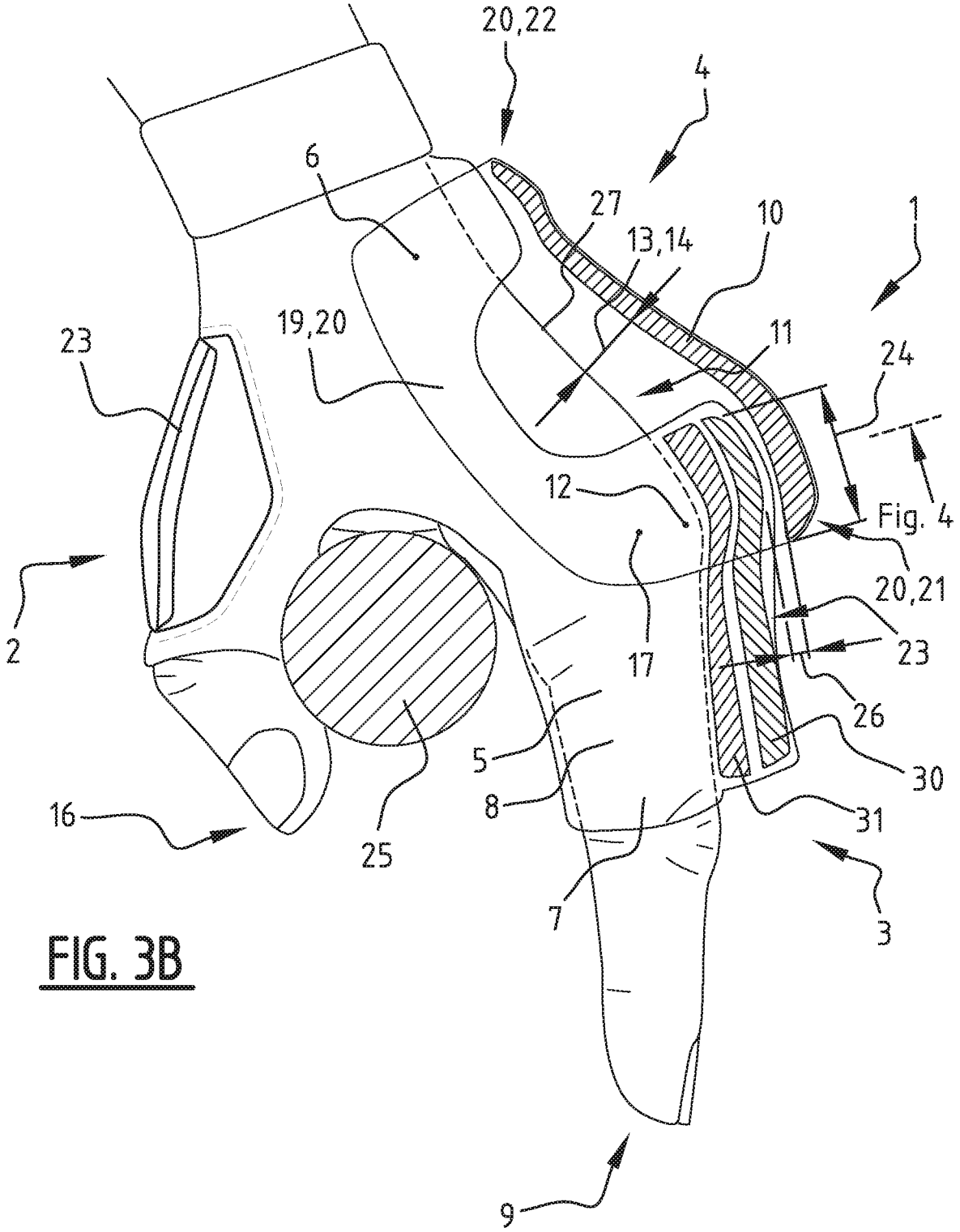
FIG. 3B is a view of the radial side of the hand while stretching the fingers to release the item.
Figure 4:
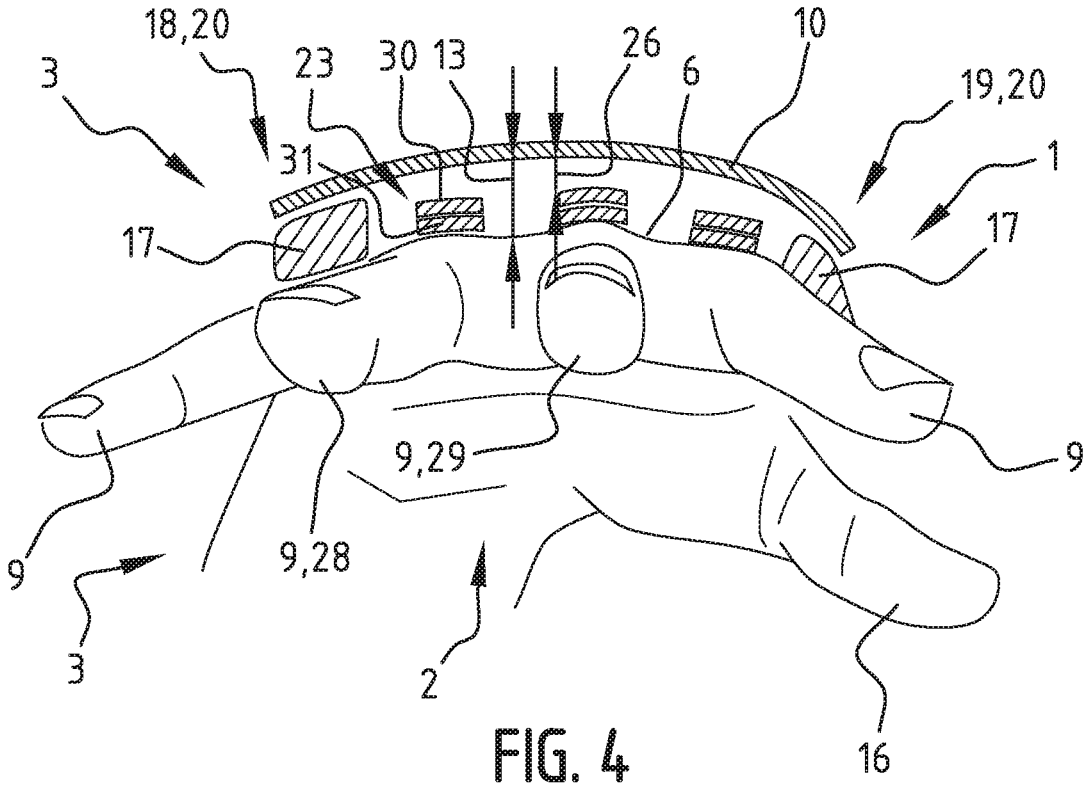
FIG. 4 is a view of a distal side of the hand with a cross sectional view of the protective glove in the metacarpal area.
Figure 5:
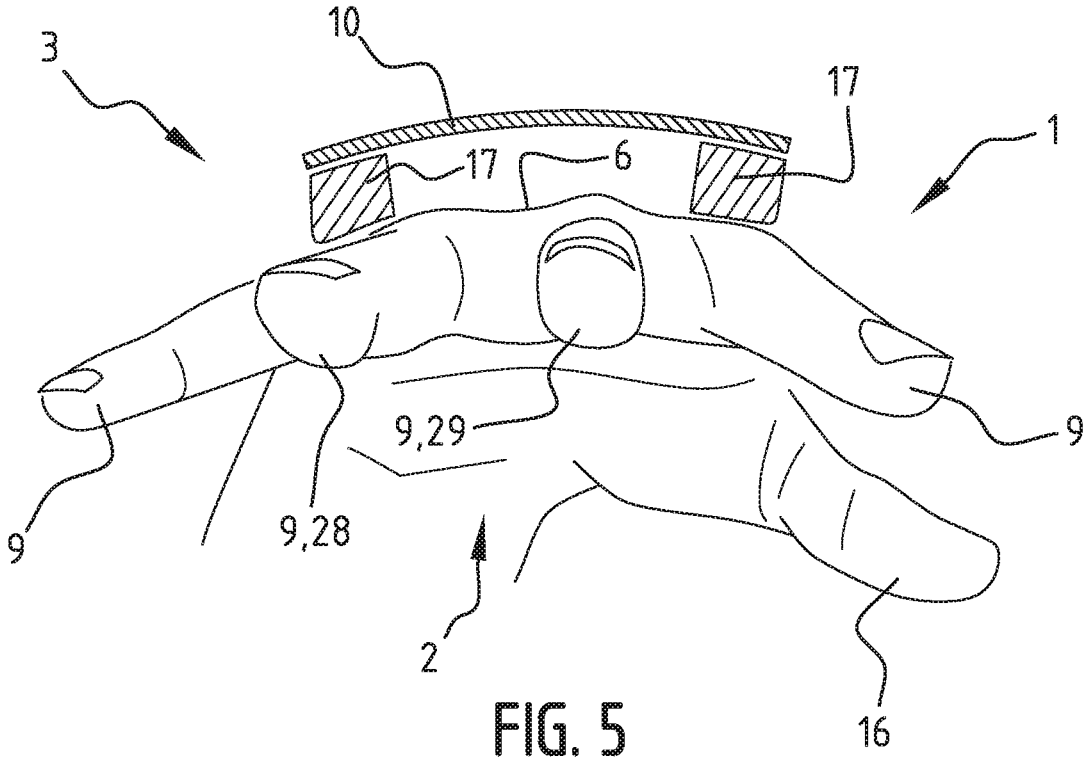
FIG. 5 is a view of a distal side of the hand with a cross sectional view of the protective glove along the line indicated in FIG. 3B.

FIGS. 3A, 3B and 4 show that the phalanx protector 23 extends in the offset 13 between the rigid shell 10 and the back 6 of the hand 3. More in particular, the phalanx protector 23 extends in the gap 14 between the shell 10 and the knuckles 12 of the hand 3. The offset 13 between the shell 10 and the back 6 of the hand 3 that defines the gap 14 between the shell 10 and the back 6 of the hand 3 not only prevents direct contact between the back 6 of the hand 3 and the shell 10, but also allows the phalanx protector 23 to move in the offset 13, i.e. in the gap 14, between the rigid shell 10 and the back 6 of the hand 3. In this way, a protection during the full range of motion may be obtained. After all, when the fingers 9 are bent to grab an object 25, such as a players stick, or to make a fist, the phalanx protectors 23 move relative to the distal edge 21 of the rigid shell 10, at the location of the knuckles 12, causing the level of overlap 24 to change Preferably, at least the phalanx protectors 23 associated with the ring finger 28 and middle finger 29 extend in the gap 14 between the shell 10 and the knuckles 12 of the hand.

As can be best seen in FIGS. 3A, 3B and 4, the protective glove 4 may comprise a further offset 26 between the rigid shell 10 and the phalanx protector 23 at the overlap 24 to thereby allow the phalanx protector 23 to freely move relative to the rigid shell 10. The phalanx protector 23 may be able to move inside the open space defined by the gap 14, allowing the phalanx protector 23 to move substantially without any friction relative to the distal edge 21 of the rigid shell 10. The further offset 26 between the rigid shell 10 and the phalanx protector 23 allows the phalanx detector 23 to move at a distance from the rigid shell 10 and thereby prevent direct sliding contact between the phalanx protector 23 and the rigid shell 10. If the phalanx protector 23 remains at a distance relative to the shell 10, any shear force there between that would be caused if there would be a sliding contact, is prevented. In this way, user comfort is even further increased, because muscular effort for moving the hand 3 and/or the fingers 9 of the hand 3 is reduced. The further offset 26 also allows for ventilation to even further increase user comfort.

The flexible layer 5 preferably comprises one or more than one opening 27 configured to be situated, during use, i.e. when the protective glove 4 is worn, at the metacarpal area 11 of the hand 3 (FIG. 1). The one or more than one opening 27, which is typically a cutout in the flexible layer 5, reduces stretch in the flexible layer 5, and thereby allows the user to move his/her fingers with significantly less resistance. Moreover, the one or more than one opening 27 also contributes to user comfort by providing additional ventilation.

The metacarpal area 11 is defined as an area where the metacarpal bones of the hand are located. Preferably, the one or more than one opening 27 is configured to be arranged, when the protective glove 4 is worn, over at least a part of metacarpal bones corresponding to a ring finger 28 and a middle finger 29 of the hand 3. Especially this area will experience stretch if a continuous flexible layer 5 is used, and consequently providing the one or more than one opening 27 is this area provides a significant contribution is reducing any resistance experienced by the user when moving the hand and/or fingers 9 throughout their range of motion.

A plurality of (not shown) small openings may jointly reduce stretch in the flexible layer 5 and provide ventilation. Preferably, the one or more than one opening 27 jointly cover an area of at least 9 $cm^2$, and preferably of at least 15 $cm^2$.

In the shown preferred embodiment, at least one of the one or more than one opening 27 comprises an area of at least 9 $cm^2$, and preferably of at least 15 $cm^2$. By providing at least one relatively large opening 25, stretch in the flexible layer 5 is further reduced and ventilation properties are further increased. Additionally, an edge of the opening 27 may function as a living hinge, thereby further reducing resistance experienced by the user when the hand 3 is moved throughout its full range of motion.

Additional ventilation and/or weight reduction is obtained if, according to a further preferred embodiment, the rigid shell 10 comprises one or more than one through hole 28 (FIG. 1).

The phalanx protector 23 may comprise a similar configuration as the assembly of shell 10 and compressible padding 17. More in particular, the phalanx protector 23 may comprise a hard shell outer layer 30 arranged on top of a compressible padding 31. The compressible padding 31 of the phalanx protector 23 may be a compressible foam layer. For example, the foam layer may be Poron© XRD. The hard shell outer layer 30 of the phalanx protector 32 may be made of polycarbonate or any other suitable material.

It is conceivable that the one or more than one extension extend over the length of a whole finger 9, including the proximal phalanx 8, the middle phalanx 32 and the distal phalanx 33. However, in order to provide optimal feel and control, especially a feel and control of a sports player of his/her stick, it is preferred that the extensions 7 leave at least the distal phalanx 33 of a finger 9 exposed. In general, the more skin contact with the stick, the better the feel and control. As shown in FIG. 2, a palm of the glove 4 may also be substantially open to allow direct contact of a user's palm on an object 15, in particular on a handle of a tool, such as a player's stick, also in view of obtaining optimal feel and control of his/her stick.

The above described embodiment is intended only to illustrate the invention and not to limit in any way the scope of the invention. Accordingly, it should be understood that where features mentioned in the appended claims are followed by reference signs, such signs are included solely for the purpose of enhancing the intelligibility of the claims and are in no way limiting on the scope of the claims. The scope of protection is defined solely by the following claims.

The invention claimed is:

1. Protective glove configured to protect a dorsal side of a hand of a user, comprising:

a flexible layer configured to fit against a back of the hand and comprising extensions that are each configured to extend along and fit against a respective proximal phalanx of a finger;

a rigid shell configured to extend over a metacarpal area and over knuckles of the back of the hand to thereby protect the back of the hand, wherein said shell is supported by said flexible layer and arranged at an offset relative to the back of the hand to thereby define a gap between the shell and the back of the hand; and wherein one or more than one of the extensions that are configured to extend along the proximal phalanx of the finger supports a phalanx protector that is configured to extend over the respective proximal phalanx, and a corresponding knuckle of the hand, and wherein, at least when the fingers are extended, the rigid shell and the phalanx protector define an overlap and the phalanx protector that extends over the corresponding knuckle slidingly extends in the offset that defines the gap between the rigid shell and the back of the hand.

2. Protective glove according to claim 1, wherein the rigid shell and the phalanx protector define an overlap during a full range of motion from the fingers being extended to the fingers being bent for grabbing an object and vice versa.

3. Protective glove according to claim 1, comprising a further offset between the rigid shell and the phalanx protector at the overlap to thereby allow the phalanx protector to freely move relative to the rigid shell.

4. Protective glove according to claim 1 wherein said shell is supported by said flexible layer via a compressible padding that is arranged between the flexible layer and the rigid shell.

5. Protective glove according to claim 4, wherein the compressible padding is arranged at an ulnar edge and at a radial edge of an outer circumference of the shell and the compressible padding is absent in a metacarpal area there between to define the gap between the shell and the back of the hand at said metacarpal area.

6. Protective glove according to claim 5, wherein the compressible padding is further arranged along a proximal edge of the outer circumference of the shell.

7. Protective glove according to claim 4, wherein the compressible padding is absent at a distal edge of the outer circumference of the shell to define the gap between the shell and the back of the hand at the knuckles of the hand.

8. Protective glove according to claim 1, wherein the flexible layer comprises one or more than one opening configured to be situated at the metacarpal area of the hand during use.

9. Protective glove according to claim 8, wherein the one or more than one opening is configured to be arranged, when the protective glove is worn, over at least a part of metacarpal bones corresponding to a ring finger and a middle finger of the hand.

10. Protective glove according to claim 8, wherein the one or more than one opening are configured to jointly cover an area of at least 9 $cm^2$.

11. Protective glove according to claim 8, wherein at least one of the one or more than one opening comprises an area of at least 9 $cm^2$.

12. Protective glove according to claim 1, wherein the rigid shell comprises one or more than one through hole.

13. Protective glove according to claim 1, wherein the phalanx protector comprises a hard shell outer layer arranged on top of a compressible padding.

14. Protective glove according to claim 1, wherein the extensions are configured to leave at least a distal phalanx of a finger exposed.

15. Protective glove according to claim 1, wherein the phalanx protector is configured to slide through the gap during flexing motion of the fingers.

* * * * *